US012674265B2

(12) United States Patent
Chung et al.

(10) Patent No.: US 12,674,265 B2
(45) Date of Patent: Jul. 7, 2026

(54) LEFTOVER LOAD DETECTION METHOD USING A HUMIDITY SENSOR IN A LAUNDRY APPLIANCE

(71) Applicant: Haier US Appliance Solutions, Inc., Wilmington, DE (US)

(72) Inventors: MyungGeon Chung, Seoul (KR); Intae Kim, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 63 days.

(21) Appl. No.: 18/665,122

(22) Filed: May 15, 2024

(65) Prior Publication Data

US 2025/0354317 A1 Nov. 20, 2025

(51) Int. Cl.

| | |
|---|---|
| ***D06F 34/26*** | (2020.01) |
| ***D06F 23/02*** | (2006.01) |
| ***D06F 33/32*** | (2020.01) |
| ***D06F 34/04*** | (2020.01) |
| ***D06F 34/18*** | (2020.01) |
| ***D06F 34/28*** | (2020.01) |
| *D06F 103/04* | (2020.01) |
| *D06F 103/34* | (2020.01) |

(Continued)

(52) U.S. Cl.

CPC ..... *D06F 34/26* (2020.02); *D06F 23/02* (2013.01); *D06F 33/32* (2020.02); *D06F 34/04* (2020.02); *D06F 34/18* (2020.02); *D06F 34/28* (2020.02); *D06F 2103/04* (2020.02); *D06F 2103/34* (2020.02); *D06F 2103/38* (2020.02); *D06F 2103/40* (2020.02); *D06F 2105/58* (2020.02)

(58) Field of Classification Search

None

See application file for complete search history.

(56) References Cited

U.S. PATENT DOCUMENTS

| | | | | |
|---|---|---|---|---|
| 7,516,629 | B2 | 4/2009 | Behrens et al. | |
| 8,984,692 | B2 * | 3/2015 | Balinski | D06F 33/43 8/149.1 |

(Continued)

FOREIGN PATENT DOCUMENTS

| | | | |
|---|---|---|---|
| CN | 103266444 | A | 8/2013 |
| CN | 105696254 | B | 12/2017 |

(Continued)

*Primary Examiner* — Cristi J Tate-Sims

(74) *Attorney, Agent, or Firm* — Dority & Manning, P.A.

(57) ABSTRACT

A laundry treatment appliance includes a cabinet; a basket rotatably mounted within the cabinet and defining a chamber configured for receiving a load of clothes; a door rotatably mounted to the cabinet; a sensor positioned within the cabinet, the sensor configured to measure a humidity of air within the cabinet; and a controller operably coupled to the sensor, the controller being configured to determine that an operating cycle of the laundry treatment appliance has been completed; determine that a user has removed the load of clothes; obtain one or more humidity measurements of the chamber using the sensor after determining that the user has removed the load of clothes; identify a leftover article remaining in the chamber by analyzing the one or more humidity measurements of the chamber; and implement a responsive action in response to identifying the leftover article remaining in the chamber.

16 Claims, 4 Drawing Sheets

(51) Int. Cl.

| | |
|---|---|
| *D06F 103/38* | (2020.01) |
| *D06F 103/40* | (2020.01) |
| *D06F 105/58* | (2020.01) |

(56) References Cited

U.S. PATENT DOCUMENTS

| | | | | |
|---|---|---|---|---|
| 9,534,337 | B2 | 1/2017 | Balinski et al. | |
| 2011/0041260 | A1* | 2/2011 | Balinski | D06F 39/04 8/159 |
| 2013/0104607 | A1* | 5/2013 | Broitzman | D06F 29/00 68/13 R |
| 2015/0167222 | A1* | 6/2015 | Hwang | D06F 34/20 68/12.02 |
| 2018/0080165 | A1 | 3/2018 | Zatorski | |
| 2019/0382941 | A1 | 12/2019 | Hwang et al. | |
| 2020/0024792 | A1 | 1/2020 | Lee | |
| 2021/0222339 | A1* | 7/2021 | Salvi | D06F 29/005 |
| 2022/0316124 | A1 | 10/2022 | Yi et al. | |
| 2024/0102230 | A1* | 3/2024 | Seo | D06F 58/30 |

FOREIGN PATENT DOCUMENTS

| | | | |
|---|---|---|---|
| CN | 107904856 | A | 4/2018 |
| CN | 111118811 | A | 5/2020 |
| CN | 112411116 | A | 2/2021 |
| CN | 116254674 | A | 6/2023 |
| JP | 2003225491 | A | 8/2003 |
| JP | 2020156527 | A | 10/2020 |
| KR | 100873907 | B1 | 12/2008 |

* cited by examiner

LEFTOVER LOAD DETECTION METHOD USING A HUMIDITY SENSOR IN A LAUNDRY APPLIANCE

FIELD OF THE INVENTION

The present subject matter relates generally to laundry appliances, and more particularly to detecting remaining laundry items within laundry treatment appliances after a completion of a laundry operation.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle of a washing machine appliance, a drain pump assembly may operate to discharge water from within sump.

After an operating cycle is completed, a user typically removes the load of clothes from the basket and transfers the load to a dryer appliance for drying. However, users frequently fail to remove all articles from a load of clothes when emptying the basket. For example, clothes may remain plastered on the sides of the basket and/or may be inadvertently overlooked by the user. Similarly, smaller items such as socks are frequently overlooked. Notably, failing to remove these items commonly results in the items being rewashed with the next wash cycle or they may produce mold, mildew, or foul smells. A similar problem may occur in a dryer appliance after a dryer appliance is performed. For example, a user may leave one or more articles behind, resulting in repeated drying cycles for a particular article, and thus unavailability of an article when it is desired and potential damage to the article.

Accordingly, a laundry treatment appliance including features and methods for ensuring all laundry articles are removed after an operating cycle would be beneficial. In particular, a laundry appliance incorporating one or more sensors for detecting the laundry articles would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet; a basket rotatably mounted within the cabinet and defining a chamber configured for receiving a load of clothes; a door rotatably mounted to the cabinet for providing selective access to the chamber; a sensor positioned within the cabinet, the sensor configured to measure a humidity of air within the cabinet; and a controller operably coupled to the sensor. The controller may be configured to determine that an operating cycle of the laundry treatment appliance has been completed; determine that a user has removed the load of clothes from the chamber; obtain one or more humidity measurements of the chamber using the sensor after determining that the user has removed the load of clothes; identify a leftover article remaining in the chamber by analyzing the one or more humidity measurements of the chamber; and implement a responsive action in response to identifying the leftover article remaining in the chamber.

In another exemplary aspect of the present disclosure, a method of operating a laundry treatment appliance is provided. The laundry treatment appliance may include a basket rotatably mounted within a cabinet and defining a chamber; a door rotatably mounted to the cabinet; and a sensor positioned within the cabinet, the sensor configured to measure a humidity of air within the cabinet. The method may include determining that an operating cycle of the laundry appliance has been completed; determining that a user has removed a load of clothes from the chamber; obtaining one or more humidity measurements of the chamber using the sensor after determining that the user has removed the load of clothes; identifying a leftover article remaining in the chamber by analyzing the one or more humidity measurements of the chamber; and implementing a responsive action in response to identifying the leftover article remaining in the chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
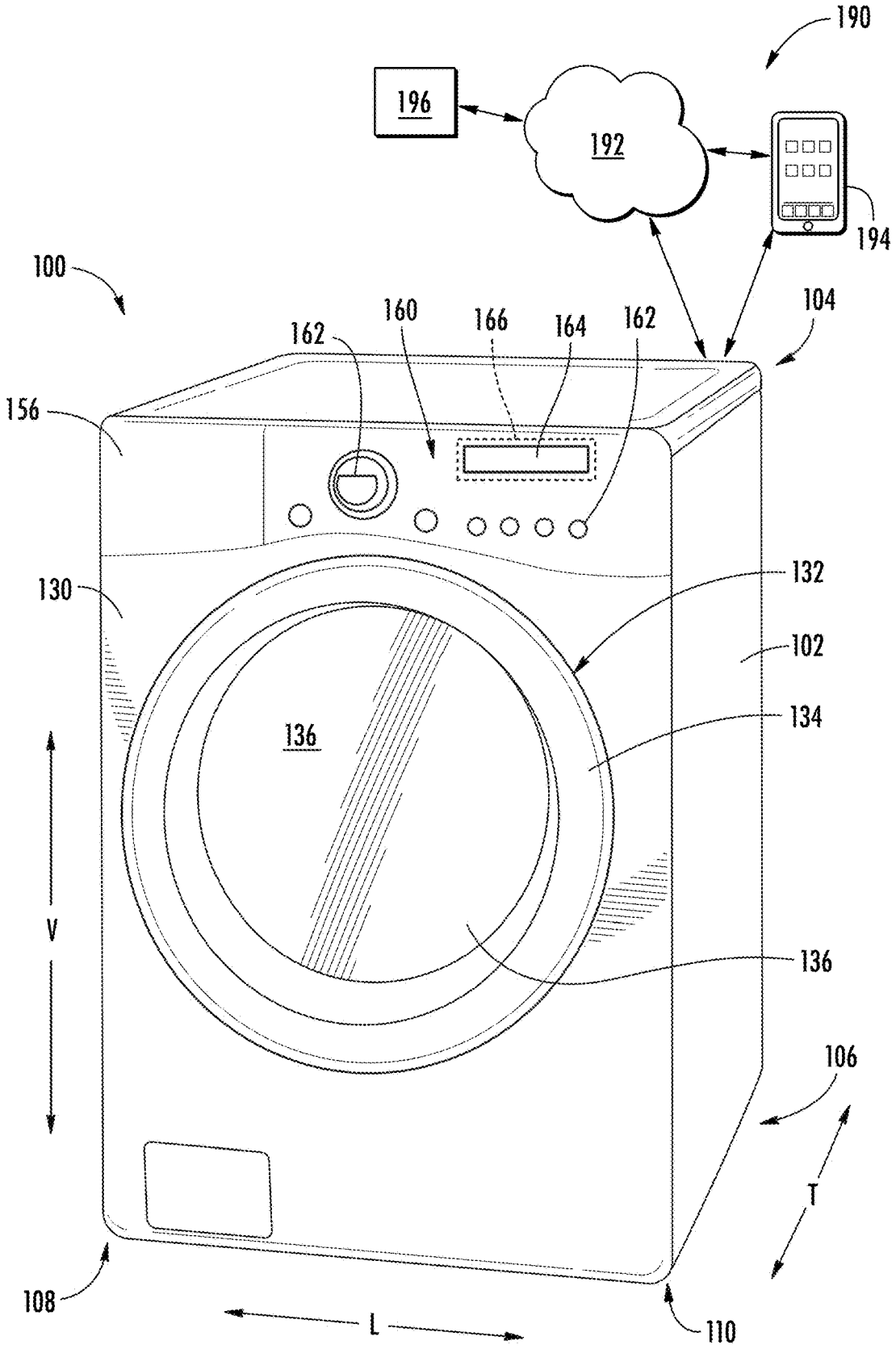
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
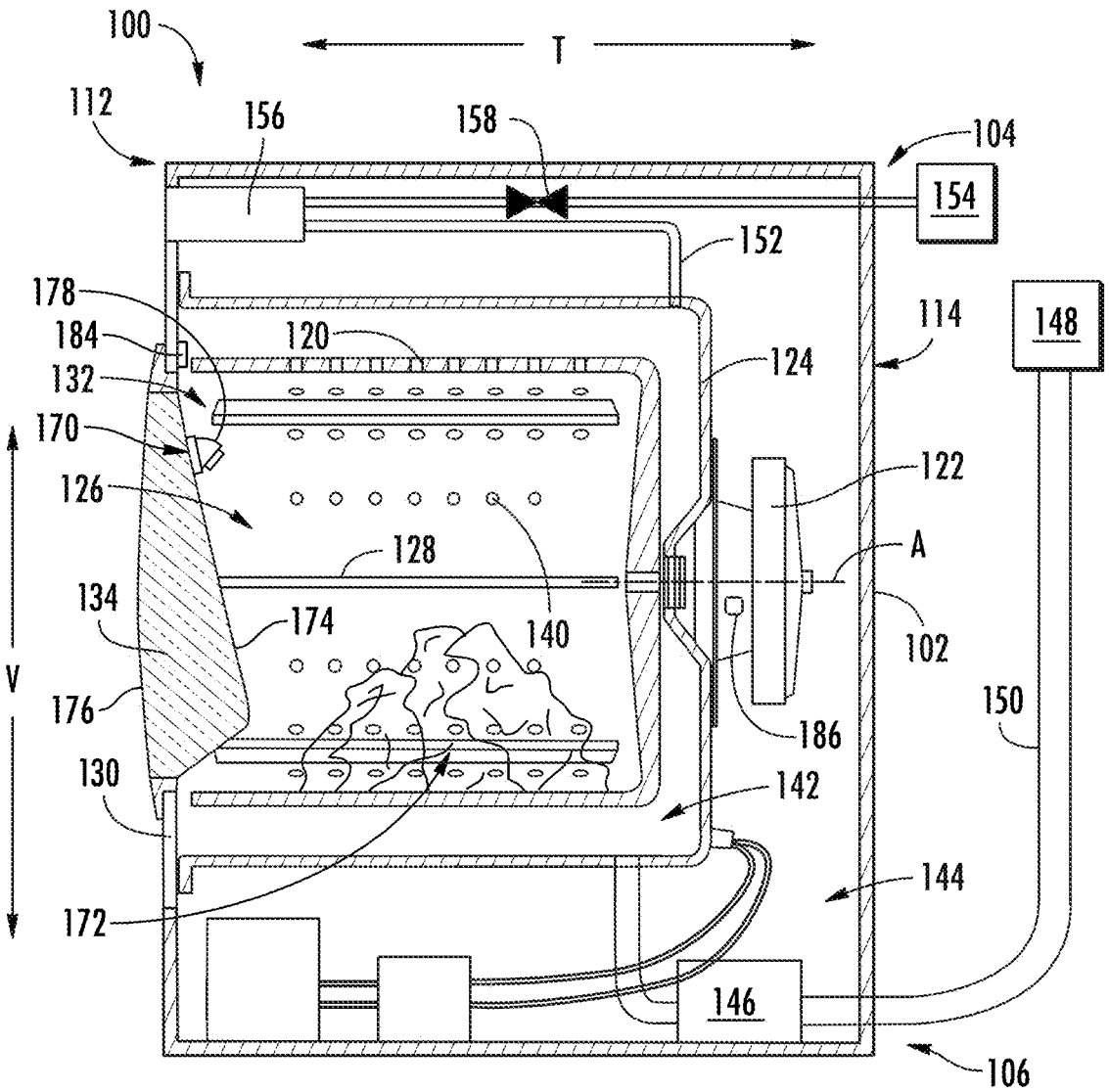
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124. Additionally or alternatively, door 134 may include an inner window 174 that partially defines wash chamber 126 and an outer window 176 that is exposed to the ambient environment.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve assembly 158 may provide a flow of water from a water supply source (such as a municipal water supply 154) into detergent dispenser 156 and into wash tub 124. In this manner, water supply valve assembly 158 may generally be operable to supply water into detergent dispenser 156 to generate a wash fluid, e.g., for use in a wash cycle, or a flow of fresh water, e.g., for a rinse cycle. It should be appreciated that water supply valve assembly 158 may be positioned at any other suitable location within cabinet 102. Moreover, it should be appreciated that water supply valve assembly 158 may include a plurality of water supply valves for independently regulating different flows of water. In this regard, for example, water supply valve assembly 158 may include two ports for receiving a hot water supply line and a cold water supply line. Water supply valve assembly 158 may further include a hot water supply valve for selectively regulating the flow of water to the hot water supply line and a cold water supply valves for selectively regulating the flow of water through the cold water supply line. In addition, although water supply valve assembly 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users. Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Laundry treatment appliance 100 may include one or more sensors 170. For example, a humidity sensor 178 is positioned within cabinet 102. As shown in FIG. 2, for instance, humidity sensor 178 may be positioned on door 134. However, the placement of humidity sensor 178 may vary according to specific embodiments, and the disclosure is not limited to the examples provided herein. Humidity sensor 178 may be configured to measure, monitor, or otherwise determine a humidity within cabinet 102 (e.g., within wash basket 120). For instance, humidity sensor 178 may be operably coupled with controller 166.

As used herein, the terms "humidity sensor" or the equivalent may be intended to refer to any suitable type of humidity measuring system or device positioned at any suitable location for measuring the desired humidity. Thus, for example, "humidity sensor" may refer to any suitable type of humidity sensor, such as capacitive digital sensors, resistive sensors, and thermal conductivity humidity sensors. In addition, humidity sensor 178 may be positioned at any suitable location and may output a signal, such as a voltage, to a controller (e.g., controller 166) that is proportional to and/or indicative of the humidity being measured. Although exemplary positioning of humidity sensors is described herein, it should be appreciated that laundry treatment appliance 100 may include any other suitable number, type, and position of humidity sensors according to alternative embodiments.

According to exemplary embodiments of the present subject matter, washing machine appliance 100 may further include a basket speed sensor 186 (FIG. 2) that is generally configured for determining a basket speed of wash basket 120. In this regard, for example, basket speed sensor 186 may be an optical, tactile, or electromagnetic speed sensor that measures a motor shaft speed (e.g., such as a tachometer, hall-effect sensor, etc.). According to still other embodiments, basket speeds may be determined by measuring a motor frequency, a back electromotive force (EMF) on motor 122, or a motor shaft speed in any other suitable manner. Accordingly, it should be appreciated that according to exemplary embodiments, a physical basket speed sensor 186 is not needed, as electromotive force and motor frequency may be determined by controller 166 without needing a physical speed sensor. It should be appreciated that other systems and methods for monitoring basket speeds may be used while remaining within the scope of the present subject matter.

Notably, controller 166 of washing machine appliance 100 (or any other suitable dedicated controller) may be communicatively coupled to the one or more sensors 170, tub light 184, basket speed sensor 186, and other components of washing machine appliance 100. As explained in more detail below, controller 166 may be programmed or configured for obtaining images using camera assembly 170, e.g., in order to detect certain operating conditions and improve the performance of washing machine appliance. In addition, controller 166 may be programmed or configured to perform methods to identify leftover articles of laundry after an operating cycle.

Referring still to FIG. 1, a schematic diagram of an external communication system 190 will be described according to an exemplary embodiment of the present subject matter. In general, external communication system 190 is configured for permitting interaction, data transfer, and other communications with washing machine appliance 100. For example, this communication may be used to provide and receive operating parameters, cycle settings, performance characteristics, user preferences, user notifications, or any other suitable information for improved performance of washing machine appliance 100.

External communication system 190 permits controller 166 of washing machine appliance 100 to communicate with external devices either directly or through a network 192. For example, a consumer may use a consumer device 194 to communicate directly with washing machine appliance 100. For example, consumer devices 194 may be in direct or indirect communication with washing machine appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with washing machine appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with washing machine appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. In addition, aspects of the present subject matter may be utilized in a combination washer/dryer appliance. Indeed, it should be appreciated that aspects of the present subject matter may further apply to other laundry appliances, such a dryer appliance. In this regard, the same methods and systems as described herein may be used to detect or identify leftover laundry articles in other appliances, such as a dryer appliance.

Now that the construction of washing machine appliance 100 and the configuration of controller 166 according to exemplary embodiments have been presented, an exemplary method 200 of operating a washing machine appliance will be described with reference to FIG. 3. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

At step 202, method 200 may include determining that an operating cycle of a laundry appliance has been completed. In this regard, continuing the example from above, a controller (e.g., controller 166) may determine that an operating cycle of washing machine appliance 100 has been completed and that items of clothing (e.g., clothing 172, FIG. 2) are ready for removal and/or transfer to an associated dryer appliance. As used herein, the terms "associated dryer appliance" and the like are generally intended to refer to a dryer appliance paired with a particular washing machine appliance, such as a dryer appliance positioned adjacent to and in the same room as a washing machine appliance. In addition, the associated dryer appliance may refer to the connected dryer appliance in the case of a combination washer/dryer unit or any other dryer appliance intended to receive the load of clothes washed in washing machine appliance.

According to some embodiments, step 202 of determining that an operating cycle of the laundry appliance has been completed may include any suitable triggering events or conditions that may be detected by the appliance controller or an appliance controller of an associated appliance (e.g., such as associated dryer appliance). For example, determining that the operating cycle has been completed may include determining that the last function or sub cycle of the washing machine appliance has been performed for a particular load of clothes. In addition, or alternatively, the appliance controller may determine that the appliance operating cycle is complete when the door is unlocked after the operating cycle, thus permitting a user to remove clothes from within the chamber.

After the operating cycle is completed, a user typically removes the load of clothes positioned within the chamber. For example, if the laundry appliance is a washing machine appliance, the user may remove the load of clothes in order to place them into a dryer appliance to facilitate a drying operation. As explained briefly above, a user may inadvertently leave one or more items, referred to herein as "leftover articles," in the chamber of the appliance. As a result, a user may believe that the leftover article has been lost, may fail to perform subsequent laundry tasks on the leftover article of clothing (such as drying or folding), or may otherwise be dissatisfied with the performance of the appliance. As such, aspects of the present subject matter are generally directed to methods of identifying leftover articles or otherwise determining that less than all of the load of clothes has been removed from the chamber of a laundry appliance.

At step 204, method 200 may include determining that a user has removed the load of clothes from a chamber of the laundry appliance. In this regard, determining that the user has removed the load of clothes may include various triggering conditions. For example, if the controller of the appliance determines that the door has been opened after completion of the operating cycle, the controller may presume that the user opened the door to remove the load of clothes. Further, if the door of the appliance has been opened after an operating cycle and no action has been taken within a predetermined amount of time, the controller may presume that the user has removed the load of clothes. It should be appreciated that the predetermined amount time may be any suitable time such as thirty minutes, one hour, two hours, or any other suitable time period.

According to still other embodiments, the triggering event may be based on subsequent actions performed by the laundry appliance or an associate a laundry appliance. In this regard, if the laundry appliance is a washing machine appliance, the triggering event that results in a determination that the user has removed the clothes may be depressing of one or more buttons on the washing machine appliance to begin initiation of another washing machine cycle. By contrast, washing machine appliance may be in communication with an associated dryer appliance, such that initiating a drying cycle or otherwise manipulating the dryer appliance (e.g., by determining that a user has initiated cycle selection for an associated dryer appliance, made dryer operating parameter inputs, etc.) in preparation for a drying cycle may trigger the washing machine appliance into determining that the user has removed the load of clothes. In any event, once the laundry appliance determines that the user has removed the load of clothes, method 200 may include steps for identifying any articles that may have been inadvertently leftover.

At step 206, method 200 may include obtaining one or more humidity measurements of the chamber using the sensor after determining that the user has removed the load of clothes. As mentioned above, one or more sensors (e.g., such as humidity sensor 178) may be positioned within cabinet 102. At the completion of the operating cycle, method 200 may initiate one or more measurements of a humidity level, for instance, within the wash chamber. As mentioned above, in determining that the user has removed the load of clothes, method 200 may determine that the door has been opened (e.g., left in an opened position) for a predetermined length of time (e.g., between about 1 hour and about 2 hours) with no other action being taken within the predetermined length of time (e.g., such as a new washing operation).

Accordingly, after an expiration of the predetermined length of time, method 200 may instruct the sensor (e.g., humidity sensor) to obtain a humidity reading. The humidity reading may indicate a relative humidity level within the wash chamber. In some instances, multiple humidity readings are taken and transmitted to a controller (e.g., controller 166). The multiple humidity measurements may then be converted to a general or overall relative humidity within the chamber.

At step 208, method 200 may include identifying a leftover article remaining in the chamber by analyzing the one or more humidity measurements of the chamber. In detail, method 200 may compare the determined humidity within the chamber against a baseline or ambient humidity. The baseline or ambient humidity may include a humidity of the room in which the laundry treatment appliances are contained, stored, installed, or otherwise positioned.

According to some embodiments, the ambient humidity measurement is obtained via a remote device in remote connection or communication with the laundry appliance. For instance, one or more additional appliances (e.g., smart appliances) may include external humidity sensors capable of measuring or determining a humidity of a room or atmosphere in general. The connected smart appliance may be a smart refrigerator, a smart microwave, a smart cooktop, a smart speaker, a thermostat, or the like. Each of the connected appliances may communicate with each other (e.g., via external communication system 190). Thus, the ambient humidity measurement may be retrieved by the laundry appliance. In additional or alternative embodiments, the ambient humidity measurement may be obtained via a secondary humidity sensor installed to the laundry appliance itself. For instance, the secondary humidity sensor may be installed at or on an external surface of the cabinet such that the ambient air within the room (e.g., outside of the cabinet) is monitored thereby.

Upon determining the ambient humidity measurement, method 200 may compare the one or more humidity measurements (e.g., chamber humidity measurements) against the ambient humidity measurement. Method 200 may then determine that at least one of the one or more humidity measurements (e.g., chamber humidity measurements) is greater than the ambient humidity measurement by a predetermined threshold. According to some instances, the predetermined threshold is between about 10% and about 15%. Accordingly, method 200 may determine that the obtained chamber humidity is greater than the ambient humidity by at least the predetermined threshold (e.g., by at least 10%). In determining that the humidity within the wash chamber is greater than the ambient humidity, method 200 may determine that one or more articles are remaining within the wash chamber after the predetermined length of time.

At step 210, method 200 may include implementing a responsive action in response to identifying the leftover article remaining in the chamber. For instance, step 210 may include providing a user notification that the leftover article remains in the chamber. It should be appreciated that the user notification may be provided to the user from any suitable source and in any suitable manner. For example, according to exemplary embodiments, the user notification may be provided through the control panel (e.g., control panel 160) so that the user may be aware of the leftover article (e.g., such as via an illuminated warning indicator, an image displayed on a screen, etc.). In addition, or alternatively, the controller may be configured to provide a user notification to a remote device, such as remote device 194 via a network. Whether provided via the control panel, the remote device, or by other means, this user notification may include useful information regarding the presence, location, or other information related to the leftover article. For example, the user notification may include a pop-up notification on a user's cell phone or other remote device. Additionally or alternatively, the user notification may include a length of time for which the leftover article has been in the chamber.

Figure 4:
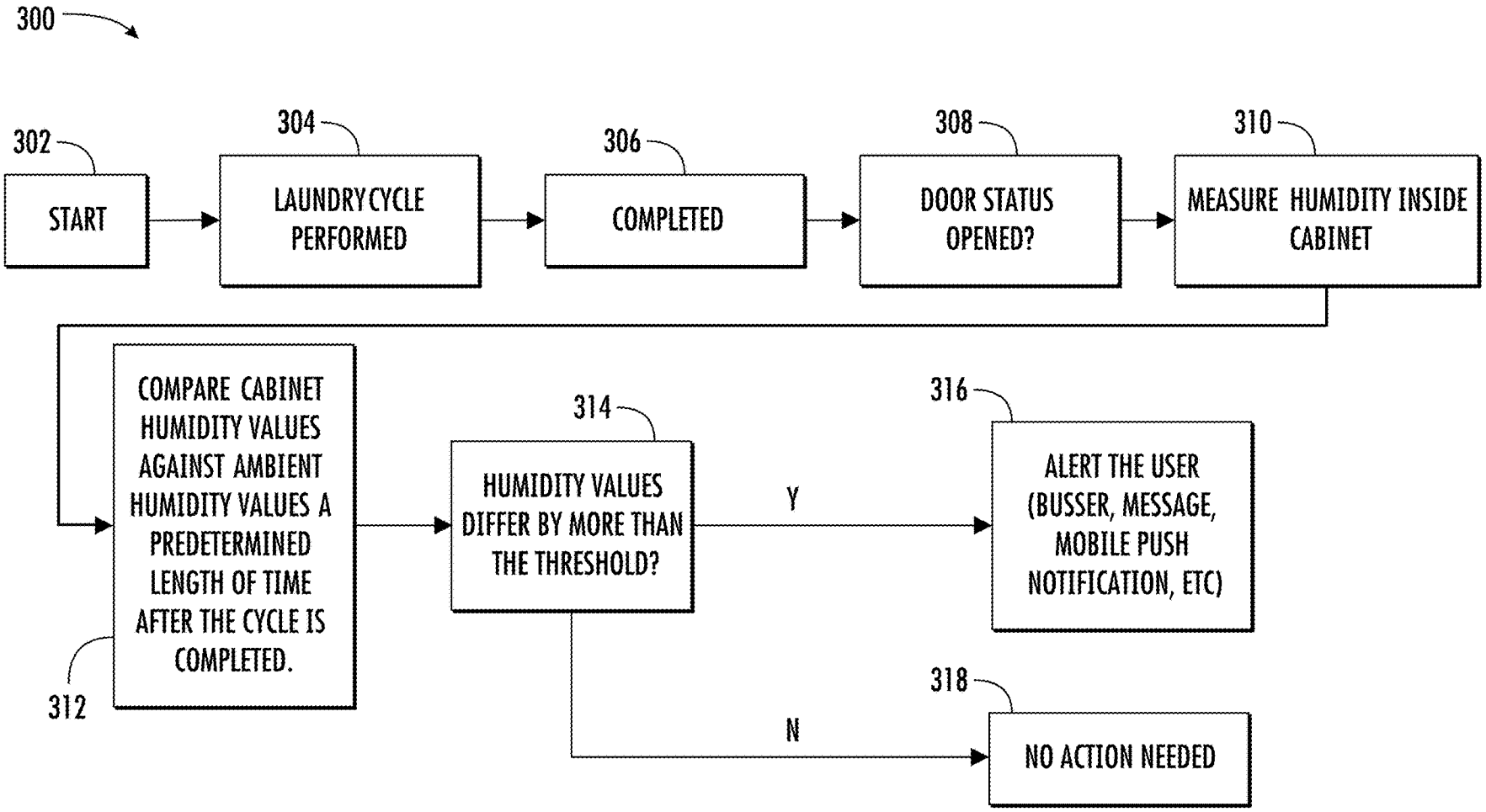
FIG. 4 illustrates a flow diagram illustrating an exemplary process for identifying leftover articles in a chamber of a laundry appliance according to an exemplary embodiment of the present subject matter.

Referring now briefly to FIG. 4, an exemplary flow diagram of a leftover article detection method 300 that may be implemented by washing machine appliance 100 (or another laundry appliance) will be described according to an exemplary embodiment of the present subject matter. According to exemplary embodiments, method 300 may be similar to or interchangeable with all or a portion of method 200 and may be implemented by controller 166 of washing machine appliance 100. As shown, at step 302, method 300 may include starting an operating cycle of a washing machine appliance, such as washing machine appliance 100. The cycle may be performed at step 304 and completed at step 306. After the operating cycle is completed the appliance controller may determine that the door has been opened at step 308. Step 310 includes a live load size estimation or leftover article identification method where a series of humidity measurements are obtained via the humidity sensor within the cabinet of the appliance.

According to the exemplary embodiment, step 312 may include comparing the cabinet humidity against an ambient humidity (e.g., within the laundry room). The comparison of the cabinet (or chamber) humidity against the ambient humidity may be performed a predetermined length of time after the completion of the laundry cycle (e.g., between about 1 hour and about 2 hours). Step 314 may include determining that the value of the cabinet humidity differs from the ambient humidity by a predetermined threshold. For instance, at step 314, method 300 may determine that the cabinet humidity is greater than the ambient humidity by at least 10%. Thus, at step 314, method 300 may determine that a leftover washing article remains within the wash basket when the cabinet humidity is greater than the ambient humidity by the predetermined threshold. When the leftover article is determined to be present, at step 316 method 300 may include alerting the user as to the presence of the article within the wash chamber (e.g., via a text message, mobile push notification, email, etc.). Conversely, when the cabinet or chamber humidity is within the predetermined threshold, method 300 may proceed to step 318 where no action is needed and the method may conclude until a new operating cycle is commenced.

Figure 3:
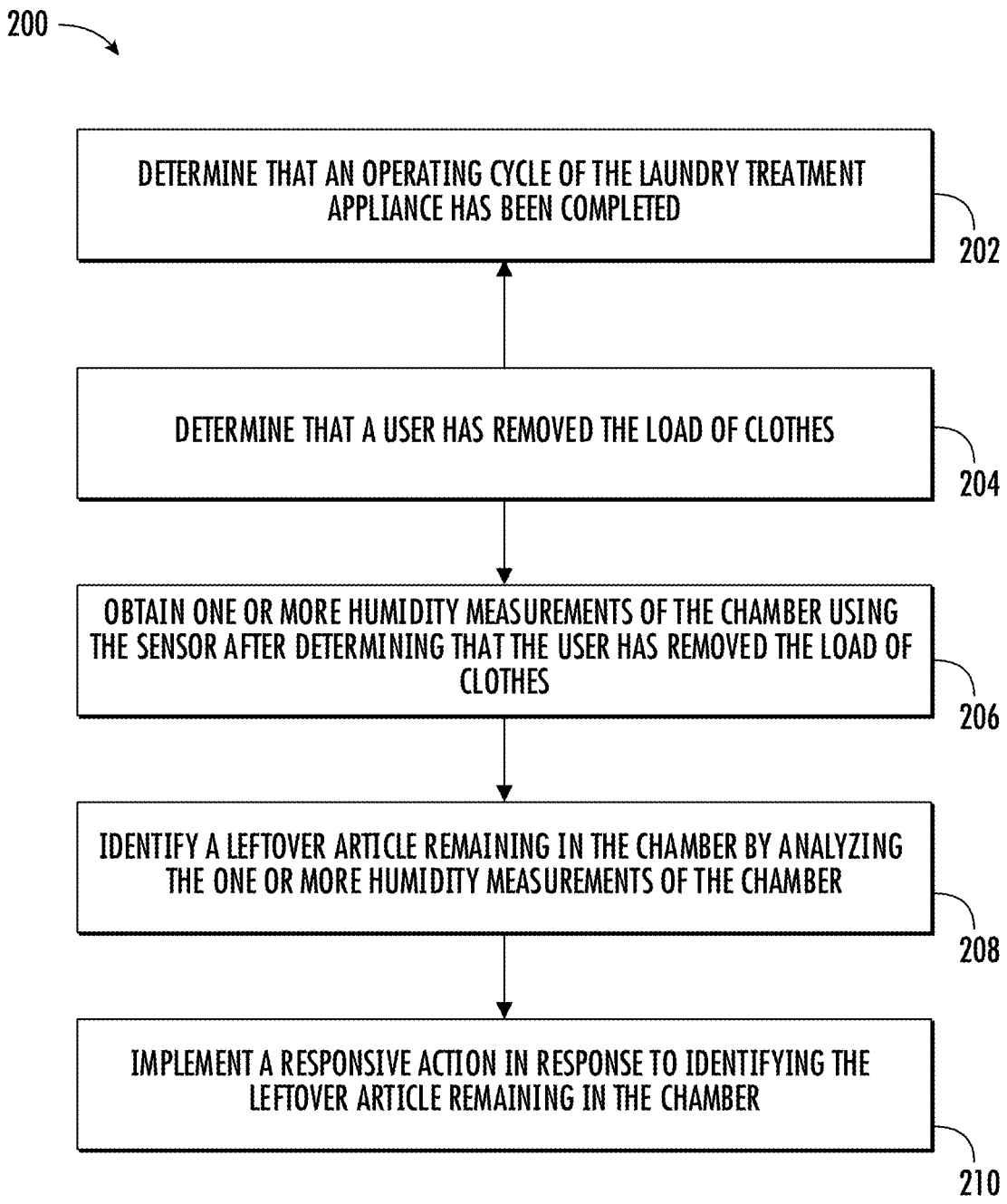
FIG. 3 illustrates a method for operating a washing machine appliance in accordance with one embodiment of the present disclosure.

FIGS. 3 and 4 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using washing machine appliance 100 as an example, it should be appreciated that this method may be applied to the operation of any suitable laundry appliance, such as another washing machine appliance or a dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance comprising:

a cabinet;

a basket rotatably mounted within the cabinet and defining a chamber configured for receiving a load of clothes;

a door rotatably mounted to the cabinet for providing selective access to the chamber;

a sensor positioned within the cabinet, the sensor configured to measure a humidity of air within the cabinet; and a controller operably coupled to the sensor, the controller being configured to:

determine that an operating cycle of the laundry treatment appliance has been completed;

determine that a user has removed the load of clothes from the chamber based on the door being opened at least once and that no other action has been taken within a predetermined time;

obtain one or more humidity measurements of the chamber using the sensor after determining that the user has removed the load of clothes;

identify a leftover article remaining in the chamber by comparing the one or more humidity measurements against an ambient humidity measurement and determining that at least one of the one or more humidity measurements is greater than the ambient humidity measurement by a predetermined threshold after a predetermined length of time; and implement a responsive action in response to identifying the leftover article remaining in the chamber.

2. The laundry treatment appliance of claim 1, wherein the predetermined time is between 1 hour and 2 hours.

3. The laundry treatment appliance of claim 1, wherein the predetermined threshold is between 10% and 15%.

4. The laundry treatment appliance of claim 1, wherein the ambient humidity measurement is obtained via a remote device in remote connection with the laundry treatment appliance.

5. The laundry treatment appliance of claim 1, wherein implementing the responsive action comprises:

providing a user notification that the leftover article remains in the chamber.

6. The laundry treatment appliance of claim 5, further comprising:

a user interface panel, wherein the user notification is provided through the user interface panel.

7. The laundry treatment appliance of claim 5, wherein the controller is in operative communication with a remote device through an external network, and wherein the user notification is provided through the remote device.

8. The laundry treatment appliance of claim 7, wherein the user notification includes displaying a warning on the remote device, the warning comprising a length of time for which the leftover article has been in the chamber.

9. A method of operating a laundry treatment appliance, the laundry treatment appliance comprising a basket rotatably mounted within a cabinet and defining a chamber; a door rotatably mounted to the cabinet; and a sensor positioned within the cabinet, the sensor configured to measure a humidity of air within the cabinet, the method comprising:

determining that an operating cycle of the laundry treatment appliance has been completed;

determining that a user has removed a load of clothes from the chamber based on the door being opened at least once and that no other action has been taken within a predetermined time;

obtaining one or more humidity measurements of the chamber using the sensor after determining that the user has removed the load of clothes;

identifying a leftover article remaining in the chamber by comparing the one or more humidity measurements against an ambient humidity measurement and determining that at least one of the one or more humidity measurements is greater than the ambient humidity measurement by a predetermined threshold after a predetermined length of time; and implementing a responsive action in response to identifying the leftover article remaining in the chamber.

10. The method of claim 9, wherein the predetermined time is between 1 hour and 2 hours.

11. The method of claim 9, wherein the predetermined threshold is between 10% and 15%.

12. The method of claim 9, wherein the ambient humidity measurement is obtained via a remote device in remote connection with the laundry treatment appliance.

13. The method of claim 9, wherein implementing the responsive action comprises:

providing a user notification that the leftover article remains in the chamber.

14. The method of claim 13, wherein the laundry treatment appliance further comprises:

a user interface panel, wherein the user notification is provided through the user interface panel.

15. The method of claim 13, wherein the laundry treatment appliance is in operative communication with a remote device through an external network, and wherein the user notification is provided through the remote device.

16. The method of claim 15, wherein the user notification includes displaying a warning on the remote device, the warning comprising a length of time for which the leftover article has been in the chamber.

* * * * *